United States Patent [19]

Van Auken

[11] 4,224,879

[45] Sep. 30, 1980

[54] RAILWAY HOPPER CAR DOOR LATCH

[75] Inventor: Charles L. Van Auken, New Cumberland, Pa.

[73] Assignee: Keystone Industries, Inc., Rolling Meadows, Ill.

[21] Appl. No.: 914,433

[22] Filed: Jun. 12, 1978

[51] Int. Cl.[2] ..... B61D 7/04; B61D 7/20; B61D 7/26; B61D 49/00

[52] U.S. Cl. ..... 105/282 P; 105/308 B; 105/308 R

[58] Field of Search ..... 105/282 P, 308 R, 308 B, 105/282 R

[56] References Cited

U.S. PATENT DOCUMENTS

| | | | |
|---|---|---|---|
| 3,529,747 | 9/1970 | Mundinger | 105/282 P X |
| 3,578,815 | 5/1971 | Mundinger | 105/282 P X |
| 3,707,126 | 12/1972 | Nester | 105/282 P |
| 3,837,294 | 9/1974 | Fossett | 105/282 P X |
| 3,956,996 | 5/1976 | Fischer | 105/282 P X |
| 3,958,514 | 5/1976 | Akester et al. | 105/282 A |

*Primary Examiner*—John J. Love
*Assistant Examiner*—Howard Beltran
*Attorney, Agent, or Firm*—Leydig, Voit, Osann, Mayer & Holt, Ltd.

[57] ABSTRACT

An outlet gate assembly for a hopper car including a frame at the bottom of the hopper with a door plate slidable therein. A pair of laterally spaced racks extend cantilever fashion from one side of the frame. A transversely extending operating shaft, mounted in brackets secured to the door plate, carries pinions which engage the teeth of the racks so that as the operating shaft is turned the pinions walk along the racks thereby imparting sliding movement to the door plate. A latch shaft extending parallel to and below the level of the operating shaft mounts, in radial position, a pair of latches having hooked portions underlying the respective racks so that when the door plate is open the latches are blocked from moving into latching position by the underside of the racks and so that when the door plate is closed the hook portions of the latches engage the ends of the racks to lock the door plate in its closed position. Operating handles at the ends of the latch shaft serve individually to rock the shaft into unlatching position with the position of the handles serving as a telltale to indicate that the door plate is both closed and latched. In one aspect of the invention the latch serves as a retention member for the door plate in that the door plate assembly may not be removed until it has traveled to fully open position and until a limit stop has been moved out of the way.

9 Claims, 7 Drawing Figures

FIG. 6
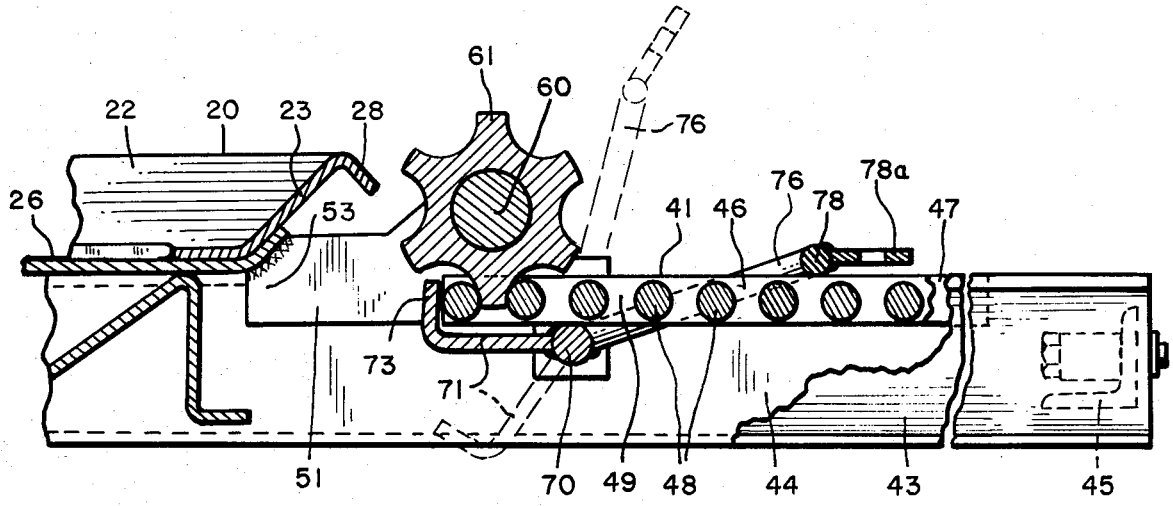
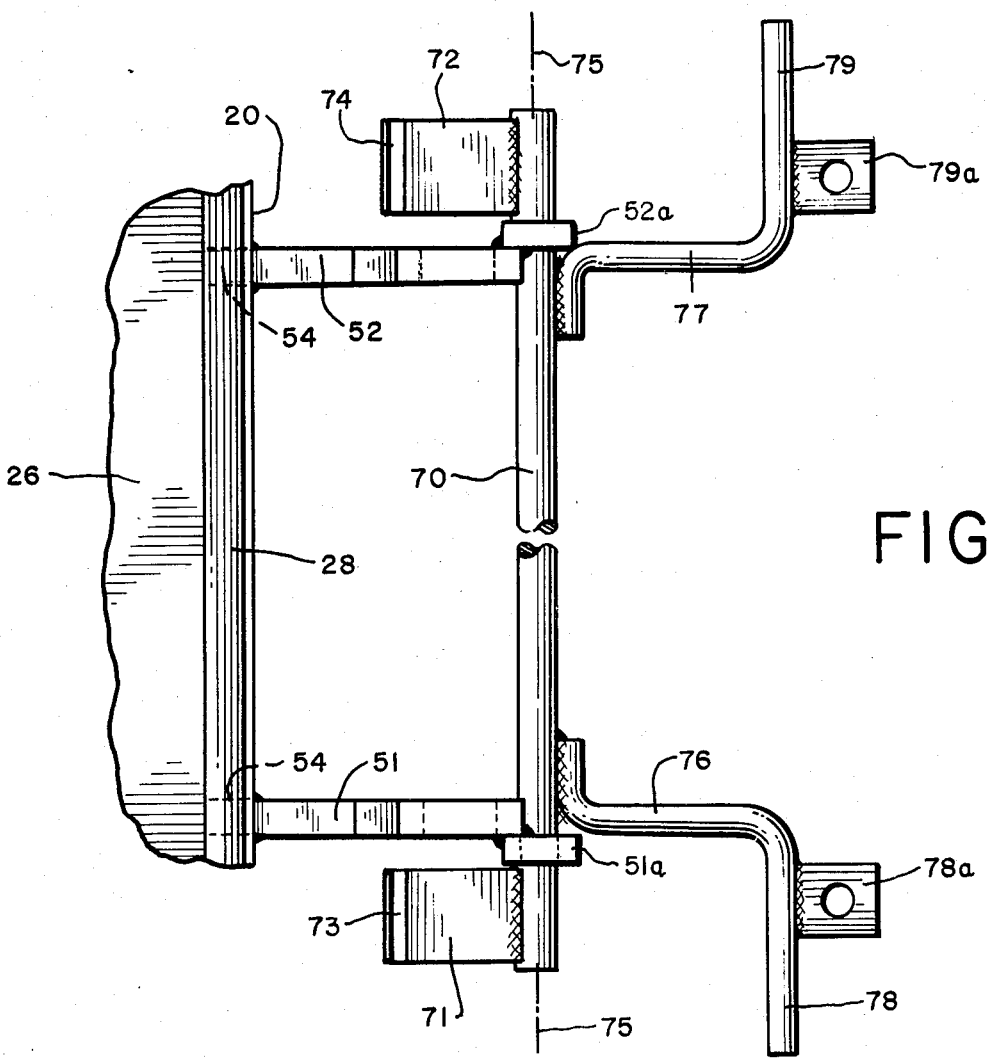
FIG. 7

RAILWAY HOPPER CAR DOOR LATCH

It is an object of the present invention to provide an outlet gate assembly for a hopper car having a latching mechanism for latching the door plate in closed position which is positive and which simultaneously locks latches both sides of the door plate. It is another object to provide a latch mechanism for locking a door plate with respect to a pair of associated racks and which is so arranged that when the door plate is open or in motion the latches are blocked, by the underside of the racks, from moving into latching position and so that when the door plate is closed the latches captively engage the ends of both of the racks. It is a related object to provide a latch mechanism for a hopper car in which the latches are mounted upon a latch shaft, the latter having operating handles at its opposite ends which, by occupying a reference position, serve as a telltale to indicate that the door plate is both closed and securely latched.

It is a general object of the invention to provide a latching mechanism for the door of a hopper car which is convenient to use, which requires only light manual pressure for operation, and which is well suited to operating in a biased mode to achieve automatic latching as the door plate is shifted into its closed position.

It is a general object of the invention to provide a latching mechanism for a hopper car which is not only positive and secure in its operation but which is simple, light in weight, low in cost and which is capable of operating for long periods of time without maintenance in spite of rust and corrosion and rough usage, which limit the life of latch mechanisms of ordinary construction. In this connection it is an object to provide an outlet gate assembly in which both the racks and latching mechanism are in a protected position and which is of narrow compact construction, minimizing lateral overhang of the racks and operating shaft and the likelihood that they may be caught on a passing obstruction.

Other objects and advantages of the invention will become apparent upon reading the attached detailed description and upon reference to the drawings in which:

FIG. 6 is a further elevation looking along line 6—6 in FIG. 3.

FIG. 7 is a layout, in plan view, showing the dual latches, shaft and operating handles.

While the invention has been described in connection with the preferred embodiment, it will be understood that I do not intend to be limited to the particular embodiment shown but intend, on the contrary, to cover the various alternative and equivalent constructions included in the spirit and scope of the appended claims.

Figure 1:
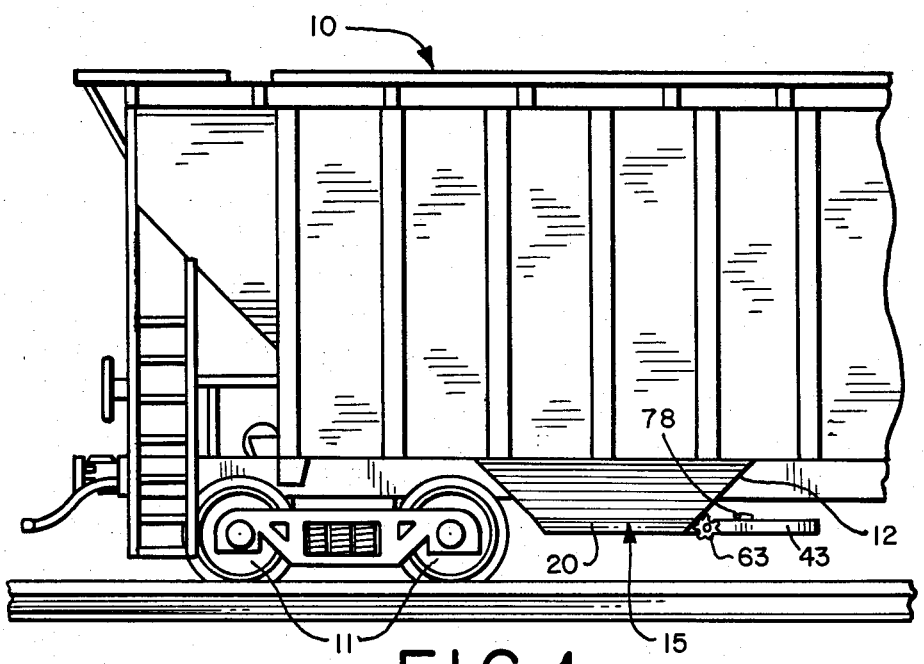
FIG. 1 is a fragmentary elevation showing one end of a hopper car to which the present invention is applied.

Turning to FIG. 1 there is shown one end of the hopper car 10 supported on a truck 11 and having a convergently walled hopper 12, at the bottom of which is an outlet gate assembly 15.

Figure 2:
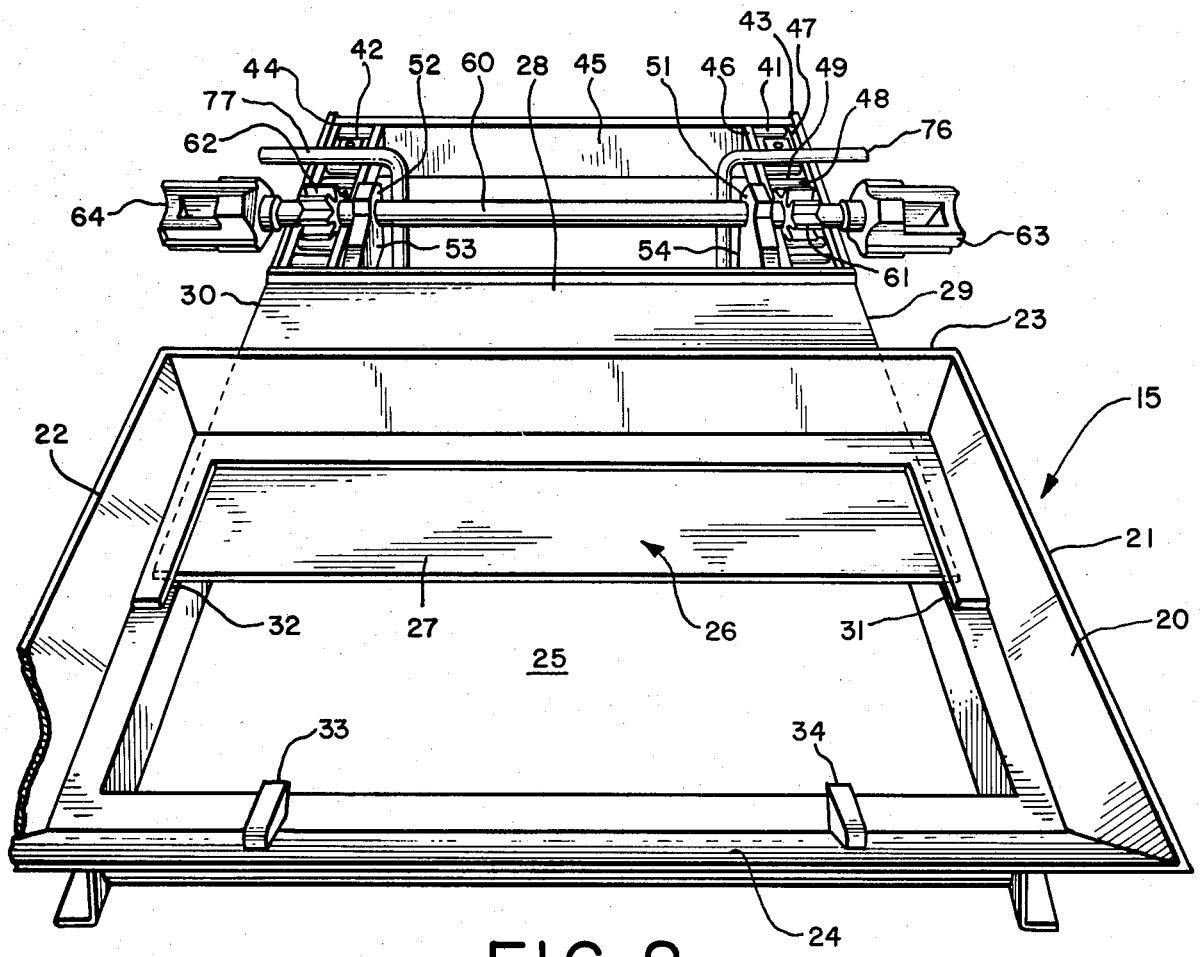
FIG. 2 is a perspective view of the outlet gate assembly forming the substance of the invention.
Figure 3:
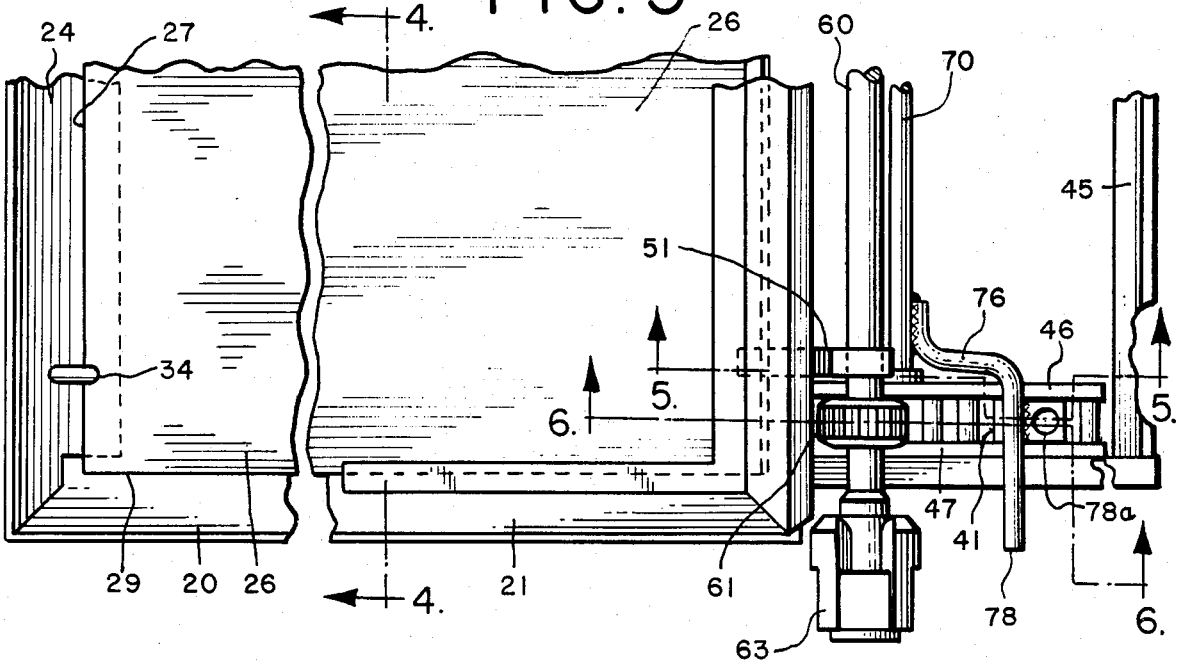
FIG. 3 is a foreshortened view of the top of the gate assembly, only the near side thereof being shown.
Figure 4:
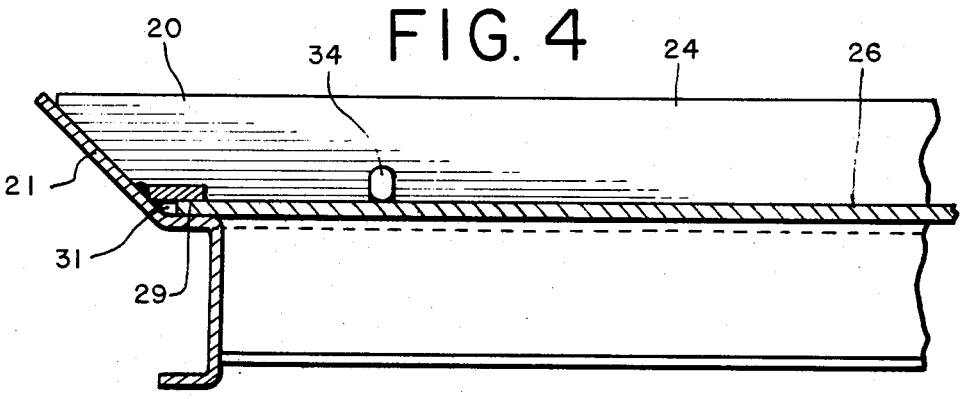
FIG. 4 is a fragmentary section taken through the gate looking along line 4—4 in FIG. 3.
Figure 5:
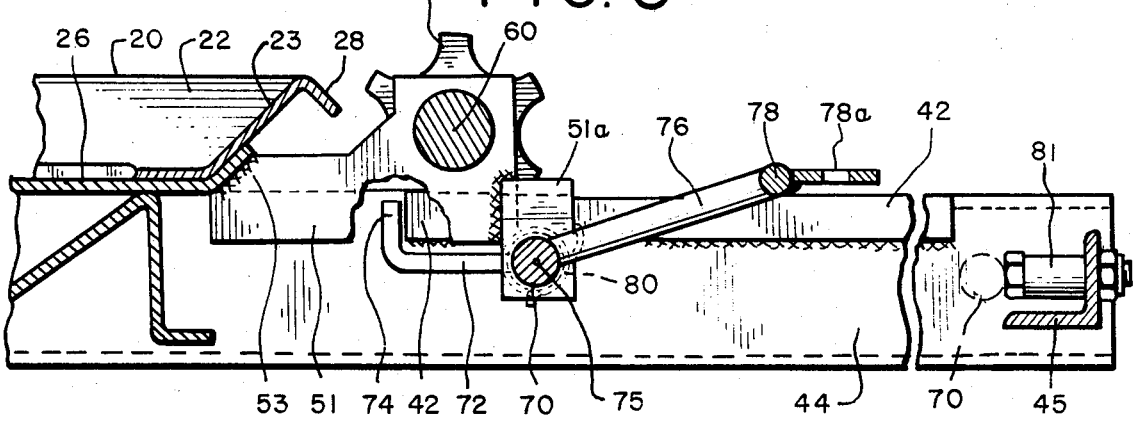
FIG. 5 is a fragmentary elevation looking along line 5—5 in FIG. 3.

As shown in FIG. 2, supplemented by FIGS. 3–5, the outlet gate assembly includes a frame 20 which is of picture frame shape having lateral ends 21, 22 and parallel edges 23, 24 defining a central opening 25. The opening is closed by a door plate 26 having leading and trailing edges 27, 28 and end edges 29, 30. The end edges are engaged in tracks 31, 32. Hold down lugs 33, 34 are interposed in the path of closing movement of the plate to cam down the leading edge 27 thereof to provide a leakproof joint.

For the purpose of actuating the door plate 26, a pair of racks 41, 42 are provided supported cantilever-fashion on brackets in the form of stringers 43, 44 which form a continuation of the underside of the door frame and which are joined at their ends by a cross member 45. Each rack is of the "ladder" type. Taking the rack 41 as representative, it is formed of longitudinal "side" rails 46, 47 having a spaced series of teeth 48 with open spaces 49 in between them to provide a self-cleaning or self-shedding action.

Adjacent the inner sides of the respective racks, and movably mounted with respect thereto, are main brackets 51, 52 anchored at their forward ends 53, 54 to the trailing edge 28 of the door plate for moving the latter. The brackets have aligned openings 55, 56.

For propelling the brackets 51, 52 and connected door plate horizontally, the brackets are engaged by an operating shaft having spaced, rack-engaging pinions 61, 62. To rotate the shaft either manually, using a bar, or by a suitable power tool, turning-tool connections 63, 64 are provided at the opposite ends of the shaft. When the shaft is rotated, the pinions 61, 62 "walk" along their respective racks to powerfully shift the door plate 26 in one direction or the other.

In accordance with the present invention, a latch mechanism is provided (see also FIG. 7) which includes a latch shaft 70 mounting a pair of latches 71, 72 having upwardly projecting hooked portions 73, 74. The latch shaft 70 is journalled with respect to the main brackets 51, 52 for rocking movement about an axis 75 which lies parallel to, and below, the level of the operating shaft 60 and the latches are spaced to underlie the respective racks and positioned to register with, and engage, the ends of the racks when the door plate is in closed condition.

For operating the latch shaft a pair of operating handles 76, 77 are provided which are bent, or extend, axially outward to provide gripping portions 78, 79 which preferably overlie the racks 41, 42 and extend beyond the racks into conveniently accessible positions adjacent to the turning-tool connections 63, 64. Welded to the portions 78, 79 of the handles are locking tabs **78*a*, 79*a***.

In accordance with one of the aspects of the present invention, the hooked end portions 73, 74 of the latch members are sufficiently wide so as to ride upon, or be blocked by, the underside of at least one of the rack siderails until the point of drop-off is reached at the end of the rack as the door plate moves into its completely closed condition. Also in accordance with a detailed aspect of the invention, the latch shaft 70 is preferably journalled, not in the main brackets 51, 52 but in a pair of bearing blocks in the form of sub-brackets **51*a*, 52*a* (FIGS. 5 & 7) which are respectively secured to the main brackets by welding or the like and which are of narrow axial dimension to minimize bearing friction. Also, the latch shaft has a diameter which is a fraction of the diameter of the operating shaft so that the latch mechanism is easily rockable with light manual effort in spite of the existence of rust or corrosion and in spite of distortion caused by hard usage. As will be noted in FIG. 7, the sub-brackets 51***a*, 52*a*, in addition to serving as bearing blocks, serve also as spacers to prevent the latches 71, 72 from directly rubbing against the main brackets 51, 52.

In accordance with still another aspect of the invention, the operating handles 76, 77 are radially longer than the associated latches and have a greater gravity moment arm, thereby to gravity-bias the latches into latching position for automatic engagement upon reaching the point of drop-off at the end of the associated rack. As an alternative means for providing bias in the latching direction, a biasing spring 80 may be used.

To review a typical operating cycle, it will be assumed that the door plate is latched in closed position with the hopper ready to be unloaded. A turning tool is applied to the "near" end of the operating shaft 60 and light manual pressure is applied to raise the gripping portion 78 of the handle 76 from its normal reference position close to the associated rack to a position several inches above the rack, resulting in rocking movement of the latches 71, 72 from the full-line position in FIG. 6 to the dot-dash position, thereby releasing the ends of the respective racks. Rotation of the turning-tool causes the pinions 61, 62 to "walk" in unison along the racks, to the right as viewed in FIGS. 3, 5 and 6. As soon as the "walking" movement begins, the latch handle may be released and the hooked portions 73, 74 of the latches will thereafter be blocked by the underside of the racks and thereby prevented from moving back into latching position.

The hooked portions 73, 74 of the latches are, as stated, wide enough to engage at least one of the longitudinal rails of each rack. Thus where bias is employed, the latches will tend to "ride" along the underside of the rack, preventing latching engagement, once the door plate has started its opening movement. Thus momentary initial release is all that is required and the operator can thereafter disregard the latch and concentrate upon securing the necessary width of opening.

Subsequently when it is desired to restore the door plate to its closed position, the operating shaft 60 is rotated in the opposite direction causing the leading edge 27 of the door plate to progressively close the opening 25. As the leading edge engages the hold down lugs 33, 34, bottoming the plate 26 at the end of its stroke, the hooked portions 73, 74 of the latches "clear" the ends of the respective racks. That is to say, the latches reach the point of drop-off in which the latch mechanism rotates clockwise about axis 75 from the blocked-open position to the full-line position illustrated in FIG. 6, either as the result of rotational bias or manual urging, thereby latchingly engaging the ends of the racks accompanied by restoration of the handles 76, 77 to reference position in which they closely overlie the upper surfaces of the racks. This indicates to the operator that the door plate is completely closed and in latched condition. Subsequently, one of the locking tabs 78*a* or 79*a* may be secured in reference position by a suitable lock; for example, a padlock which has a hasp extending through the locking tab and through a registering opening in the associated rack.

Since latching engagement occurs at both ends of the frame, the latching is doubly reliable, both latches being operable and fully accessible from either side of the hopper car.

The latching mechanism is not only more effective in performing its function than other latching mechanisms previously employed but it is also in a more protected position, shielded from inadvertent disengagement by passing objects. The racks in the present construction are also in a more protected position than in prior devices of the same type. Specifically, the racks are spaced inwardly from the ends 21, 22 of the frame and within the lateral dimension of the door plate. The racks positioned in this manner act to support the door and to act as door guides interposed between the door plate and latch shaft. Spacing the racks inwardly of the end edge of the door plate enables the pinions and the turning tool connections 63, 64 to be moved inwardly by a corresponding amount. This minimizes the lateral "overhang" of the operating shaft, as well as the racks, and the likelihood of catching on a passing obstruction.

It will be apparent, then, that the objects of the invention are amply fulfilled: Latching is positive and occurs simultaneously on both sides of the door plate. Upon opening of the door plate the latches need be only temporarily unseated, following which they are automatically blocked out of engagement as the door plate moves to open position. When the door plate is restored to closed position, the latches, either manually or automatically, by light pressure, are moved to latching condition, accompanied by movement of the operating handles to reference position which serves as a telltale to indicate that the door plate is both closed and latched.

While the construction is lighter, by fifty pounds or so, as compared with prior door and latch assemblies, such reduction is accomplished without compromising strength. The torque required to move the latches between the limit positions is much lighter than the forces normally required, and is little affected by the existence of rust or corrosion in the supporting bearings. Thus, the structure is well suited and sensitive enough to operate in the bias mode, utilizing either gravity or spring bias, to achieve automatic latching as the door is shifted into closed position. The mechanism is not only much more economical than prior outlet gate assemblies but is capable of operating for long periods of time in the face of weathering and rough usage without requiring maintenance or repair.

In accordance with one of the aspects of the present invention the racks are spaced inwardly from the lateral ends of the frame and substantially within the lateral dimension of the door plate to support the door plate as it is moved between closed and open positions. Moreover, the latch shaft is positioned to ride back and forth under the racks so that the entire door plate assembly consisting of the door plate, with its brackets 51, 52, operating shaft 60 and latch shaft 70, and the parts which are secured thereto (see FIG. 7), are normally all held in captive position. A limit stop 81 arranged in the path of final opening movement of the assembly (see FIG. 5) is removable to permit movement of the latch shaft beyond the racks into a non-captive position from which it may be swung upwardly, clear of the ends of the racks, permitting the door plate assembly to be removed from the frame as a unit for servicing or the like.

I claim:

1. In an outlet gate assembly for a hopper car, the combination comprising a frame horizontally positioned at the bottom of the hopper, a door plate slidable therein between a closed position and an open discharging position, a pair of racks each having a series of teeth and extending parallel to one another cantilever-fashion from one side of the frame, the racks being spaced to occupy positions adjacent the respective ends of the frame, a pair of main brackets secured to the edge of the door plate adjacent the inner sides of the respective racks, an operating shaft journalled in the brackets and having pinions rigidly secured thereto engaging the teeth in the racks, the operating shaft having a turning-tool connection at its respective ends for rotating the shaft so that the pinions walk along the racks for sliding of the door plate, a latch shaft having means on the door plate for journalling the same and extending parallel to and below the level of the operating shaft, the latch shaft having a pair of operating handles each secured thereto in radial relation and extending outwardly for convenient access from either side of the car, said handles having a reference position, said latch shaft having secured to its respective outer ends in radially extending position a pair of latches having hooked end portions, the latches being spaced to underlie the respective racks so that when the door plate is open the latches are blocked from moving into latching position by the underside of the racks and so that when the door plate is closed the hooked end portions of the latches latchingly engage the ends of both of the racks accompanied by rocking of the latch shaft and the handles thereon to reference position indicating that the door plate is both closed and latched.

2. The combination as claimed in claim 1 in which the racks are spaced inwardly from the ends of the frame and substantially within the lateral dimension of the door plate to guide the latter.

3. The combination as claimed in claim 2 in which the operating handles extend outwardly beyond the respective racks into positions adjacent the turning-tool connections at each end of the operating shaft.

4. The combination as claimed in claim 1 in which the racks are of the ladder type having side rails and in which the hooked end portion on each of the latches is sufficiently wide as to ride upon the underside of at least one of the side rails until the point of drop-off at the end of the rack is reached.

5. The combination as claimed in claim 1 in which the handles are radially longer than the associated latches and have a greater gravity moment arm thereby to bias each latch into latching position for automatic latching engagement upon reaching the point of drop-off at the end of the associated rack.

6. The combination as claimed in claim 1 in which the latch shaft is journalled in a pair of sub-brackets of narrow axial dimension and which are respectively secured to the main brackets and the latch shaft having a diameter which is a fraction of the diameter of the operating shaft thereby to minimize any frictional opposition to rocking movement of the latch shaft.

7. In an outlet gate assembly for a hopper car, the combination comprising a frame horizontally positioned at the bottom of the hopper, a door plate slidable therein between a closed position and an open discharging position, a pair of stationary racks secured to the frame each having a series of teeth and extending parallel to one another cantilever-fashion from one side of the frame, the racks being spaced to occupy positions generally aligned with the respective ends of the door, a pair of main brackets secured to the edge of the door plate adjacent the inner sides of the respective racks, an operating shaft journalled in the brackets and having pinions rigidly secured thereto engaging the teeth in the racks, the operating shaft having a turning-tool connection at its respective ends for rotating the shaft so that the pinions walk along the racks for sliding of the door plate, a latch shaft having means on the door plate for journalling the same below the level of the racks and extending parallel to and below the level of the operating shaft, the latch shaft having a pair of operating handles secured thereto in radial relation extending angularly upward above the level of the racks and extending axially outwardly to overlie the respective racks in a reference position, said latch shaft having secured to its respective outer ends in generally horizontally extending position a pair of latches in the form of plates having upwardly hooked end portions, and means for biasing the latches upwardly toward latching position, the latches being spaced to underlie the respective racks so that when the door plate is in motion the latches ride on the underside of the racks and so that when the door plate is closed the hooked end portions of the latches latchingly engage the ends of both of the racks accompanied by rocking of the latch shaft and the handles thereon to reference position indicating that the door plate is both closed and latched.

8. In an outlet gate assembly for a hopper car, the combination comprising a frame horizontally positioned at the bottom of the hopper, a door plate assembly including door plate slidable therein between a closed position and an open discharging position, a pair of rack members each having a series of teeth and extending parallel to one another cantilever-fashion from one side of the frame, the door plate assembly including a set of main brackets secured to the edge of the door plate adjacent the inner sides of the respective rack members together with an operating shaft journalled in the brackets and having pinions rigidly secured thereto engaging the teeth in the rack members, the operating shaft having a turning-tool connection for rotating the shaft so that the pinions walk along the rack members for sliding of the door plate, the door plate assembly further including a latch shaft having means on the door plate for journalling the same and extending parallel to and along the operating shaft, the latch shaft having at least one operating handle secured thereto in radial relation extending outwardly for convenient access and having a reference position, said latch shaft having secured to at least one end in a radially extending position alined with the associated rack member a latch having a hooked end portion so that when the door plate is closed the hooked end portion of the latch engages the end of the associated rack member, accompanied by rocking of the latch shaft and the handle thereon to reference position indicating that the door plate is both closed and latched, the rack member being spaced inwardly from the ends of the frame and substantially within the lateral dimension of the door plate to support the door plate as it is moved between the closed and open positions, the latch shaft being positioned to ride captive under the rack members thereby to hold the entire door plate assembly captive over the range of sliding movement of the door plate.

9. The combination as claimed in claim 8 in which a stop is interposed in the path of final opening movement of the door plate assembly, said stop being removable to permit movement of the latch shaft beyond the racks into a position permitting the door plate assembly to be removed for servicing.

* * * * *